United States Patent [19]

Moss

[11] Patent Number: 4,720,987

[45] Date of Patent: Jan. 26, 1988

[54] MULTI PURPOSE LOCK DEVICE

[76] Inventor: Ronald Moss, 350 Ocean Pkwy., Brooklyn, N.Y. 11226

[21] Appl. No.: 869,661

[22] Filed: Jun. 2, 1986

[51] Int. Cl.[4] ..... E05B 67/22

[52] U.S. Cl. ..... 70/39; 70/38 A; 109/23

[58] Field of Search ..... 70/39, 38 C, 38 A; 109/52, 23, 51, 50

[56] References Cited

U.S. PATENT DOCUMENTS

| | | | |
|---|---|---|---|
| 1,384,590 | 7/1921 | Bottone | 70/39 |
| 1,955,809 | 4/1934 | Hobbs | 70/38 C |
| 2,813,620 | 11/1957 | Hansen | 109/23 |
| 3,084,532 | 4/1963 | Williams | 109/23 |
| 3,858,531 | 1/1975 | Rubenstein | 109/23 |
| 4,066,967 | 1/1978 | Spina | 312/7.1 |
| 4,429,554 | 2/1984 | Litvin | 70/364 |
| 4,457,240 | 7/1984 | Hungerford | 109/50 |

FOREIGN PATENT DOCUMENTS

| | | | |
|---|---|---|---|
| 56884 | 6/1922 | Belgium | 109/1 |

OTHER PUBLICATIONS

Dictionary of Locksmithing by Keith Mayers TM 1973.

*Primary Examiner*—Henry E. Raduazo
*Attorney, Agent, or Firm*—Richard L. Miller

[57] ABSTRACT

A multi purpose lock device is provided to be used with a hanger and other items such as a flashlight, radio, tape recorder, first aid kit, exit light, piggy bank, clock and smoke alarm or burglar alarm. The lock consists of a housing affixed to one of such items and a shackel which can be locked around any suitable pole, abutment, doorknob or the like.

1 Claim, 3 Drawing Figures

MULTI PURPOSE LOCK DEVICE

BACKGROUND OF THE INVENTION

The instant invention relates to locks and more particularly to a multi purpose lock device.

Security of personal belongings is a well known concern. Many people seek to protect their valuables by securing their homes with locks, alarms and safes. Maintaining this security when traveling is not possible.

Therefore there exist the need for a multi purpose lock device capable of transport.

SUMMARY OF THE INVENTION

It is an object of this invention to provide a new and improved lock device.

It is another object of this invention to provide a new and improved lock device for use with a hanger.

It is yet another object of this invention to provide a new and improved lock device for use with a hanger with hidden compartments.

It is still another object of this invention to provide a new and improved lock device for use with a flashlight.

It is a further object of this invention to provide a new and improved lock device for use with a first aid kit.

It is yet still another object of this invention to provide a new and improved lock device for use with a tape recorder or radio.

An additional object of this invention is to provide a new and improved lock device for use with an exit light.

It is still yet another object of this invention to provide a new and improved lock device for use with a piggy bank.

It is yet further object of this invention to provide a new and improved lock device for use with a clock.

It is further still another object of this invention to provide a new and improved lock device for use with a smoke alarm, or burglar alarm.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The FIGS. in the drawings are briefly described as follows.

DESCRIPTION OF THE PREFERRED EMBODIMENT

Figure 1:
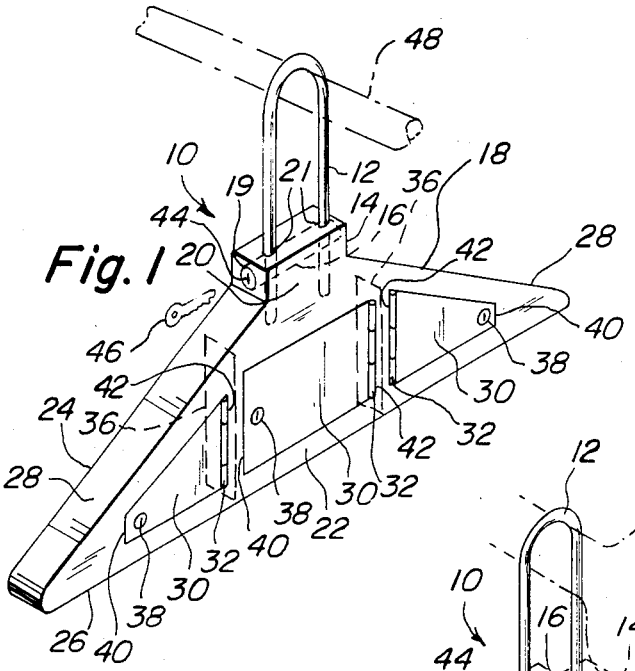
FIG. 1 is a perspective view of the invention illustrated incorporated with a hanger.

FIG. 1 generally shows a multi purpose lock device 10. Multi purpose lock device 10 consists of a shackel 12, a housing 14 and a tumbler 16. Housing 14 in the form of a rectangular parallelepiped with a cylindrical cavity 19 of predetermined size to coact with tumbler 16 and pair of holes 21 perpendicular to cavity 19 disposed to coact with shackel 12 is incorporated in a hanger 18 (FIG. 1) and is disposed at a top portion 20 thereof. Holes 21 are also disposed through tumbler 16. Housing 14 may be an integral part of hanger 18 or an independent device conventionally attached thereto. Hanger 18 is constructed of heavy gauge steel, aluminum, tough plastic or the like. Shackel 12 is high tensile steel. Hanger 18 has a front 22, a back 24, both in the form of truncated triangles, a bottom 26 of rectangular form and a pair of sides 28 rectangular in form.

Disposed in front 22 are a set of compartment doors 30. Doors 20 are affixed to front 22 which is cut out to accept doors 30 with a set of hinges 32. Sides 28 are of a predetermined thickness to facilitate the storage of valuables in a set of compartments (not shown) which are internal to hanger 18 formed by a pair of supports 36 positioned in the hollow of hanger 18 between doors 32. Each door 32 is fitted with a lock 38 mounted proximate a first side 40 opposed a second side 42 where the hinge is affixed. The method of operation of locks 38 is a key combination or the like. Shackel 12 is removed from tumbler 16 by operating lock 44 with key 46 both commercially available. Shackel 12 is deployed over a shaft 48 and reinserted into tumbler 16. Shaft 48 may be a conventional closet pole and take the form of a cylindrical rod of steel, aluminum, wood or the like permanently attached at both ends to a pair of walls (not shown), or may be doorknob 50 or the like.

Figure 2:
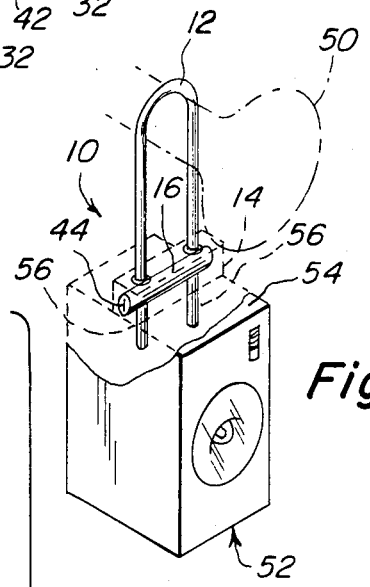
FIG. 2 is a view similar to FIG. 1 but illustrated with a flash light.

Multi purpose lock 10 is shown in FIG. 2 affixed to to flashlight 52. Flashlight 52 is modified to coact with shackel 12 and housing 14. Housing 14 is screwed, welded or otherwise conventionally affixed to flashlight 52. Additionally a top 54 of flashlight 52 is molded, drilled or fitted with a pair of holes 56 perpendicular to the plain of top 54. Holes 56 are of a predetermined diametral size and depth to coact with shackel 12.

Figure 3:
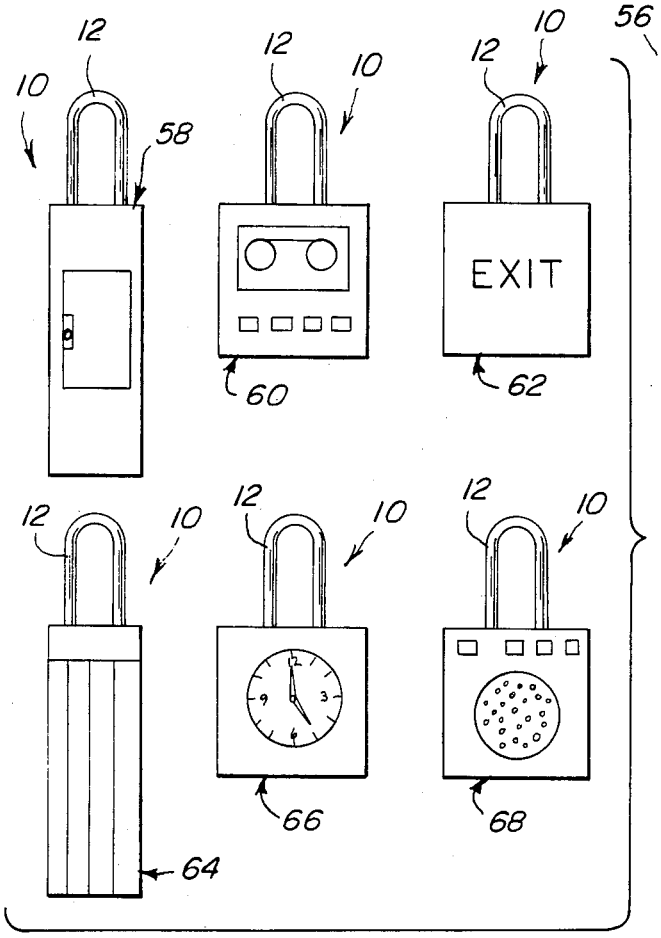
FIG. 3 illustrates the invention being incorporated with various other accessories.

In FIG. 3 there is shown multi purpose lock device 10 coacting with: a first aid kit 58, a tape recorder 60, an exit light 62, a piggy bank 64, a clock 66, a smoke or burglar alarm 68 and a radio (not shown). Each of these items is modified in a manner similar to that described for a flashlight 52.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A multi purpose lock device incorporated in an item having a member, said lock device comprising:

(a) a shackel in the form of a U-shaped rod;

(b) a housing means incorporated within said member and in the form of a parallelpiped having a cylindrical cavity centrally disposed therein, and a set of holes perpendicular to said cavity which coacts with said shackel, two holes also disposed in said member of said item with said holes in said member being of a predetermined diametral size, depth and location so as to coact with said shackel; and (c) a lock cylinder carried by said housing means containing a set of holes which coact with said shackel said lock cylinder being in the general form of a cylinder of predetermined size to be received within said cavity, said externally manipulatable of said item, wherein said multi purpose lock device is incorporated in a hanger comprising:

(i) a front panel of essentially triangular form with a plurality of cut outs:

(ii) a back panel of essentially triangular form;

(iii) a bottom panel of rectangular form;

(iv) a pair of sides of rectangular form;

(v) a plurality of doors;

(vi) a plurality of hinges of conventional design;

(vii) a plurality of lock sets; and (viii) said front panel, said back panel, said sides and said housing means secured together to form a solid form which is essentially triangular; wherein said doors are affixed to said hinges, said hinges conventionally mounted to said front panels so as to coact with said cut outs of said front panel, said locks disposed to lock said door in closed disposition.

* * * * *